US008449988B2

(12) United States Patent
Shiraki et al.

(10) Patent No.: US 8,449,988 B2
(45) **Date of Patent: *May 28, 2013**

(54) HIGH-STRENGTH COLD-ROLLED STEEL SHEET EXCELLENT IN BENDING WORKABILITY

(75) Inventors: Atsuhiro Shiraki, Kakogawa (JP); Sae Hamamoto, Kakogawa (JP); Yukihiro Utsumi, Kakogawa (JP); Tetsuji Hoshika, Kakogawa (JP); Yuichi Futamura, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/099,616

(22) Filed: May 3, 2011

(65) Prior Publication Data

US 2011/0287280 A1 Nov. 24, 2011

(30) Foreign Application Priority Data

May 24, 2010 (JP) ..... 2010-118655

(51) Int. Cl.
*B32B 15/01* (2006.01)
*B32B 15/04* (2006.01)
*B32B 15/18* (2006.01)

(52) U.S. Cl.
USPC ..... 428/659; 428/684; 428/213

(58) Field of Classification Search
USPC ..... 428/687, 658, 659, 682, 683, 684, 428/685, 213, 220
See application file for complete search history.

(56) References Cited

U.S. PATENT DOCUMENTS

2010/0247957 A1* 9/2010 Hoshika et al. ..... 428/659

FOREIGN PATENT DOCUMENTS

| | | | |
|---|---|---|---|
| CN | 101155940 A | | 4/2008 |
| CN | 101351570 A | | 1/2009 |
| GB | 2470252 A | | 11/2010 |
| JP | 3421943 | | 4/2003 |
| JP | 2004-068050 | * | 3/2004 |
| JP | 2005-272888 | | 10/2005 |
| JP | 3845554 | | 8/2006 |

OTHER PUBLICATIONS

Machine Translation, Nomura et al., JP 2004-068050, Mar. 2004.*
United Kingdom Combined Search and Examination Report issued Jan. 18, 2012 in patent application No. GB1108584.2.
Chinese Office Action Issued Aug. 1, 2012 in Patent Application No. 201110134643.1 (with English translation).

* cited by examiner

*Primary Examiner* — Michael La Villa
(74) *Attorney, Agent, or Firm* — Oblon, Spivak, McClelland, Maier & Neustadt, L.L.P.

(57) ABSTRACT

A cold-rolled steel sheet has a chemical composition of C: 0.12% to 0.3%, Si: 0.5% or less, Mn: less than 1.5%, Al: 0.15% or less, N: 0.01% or less, P: 0.02% or less, and S: 0.01% or less, with the remainder including iron and inevitable impurities and has a martensite single-phase structure as its steel microstructure. In a surface region of the steel sheet from the surface to a depth one-tenth the gauge, the number density of n-ary groups of inclusions determined by specific n-th determinations is 120 or less per 100 $cm^2$ of a rolling plane, where the distance in steel sheet rolling direction between outermost surfaces of two outermost particles of the group of inclusions is 100 μm or more. The steel sheet is a high-strength cold-rolled steel sheet which has a sufficiently minimized rate of bending fracture starting from inclusions and thereby has excellent bending workability.

9 Claims, 6 Drawing Sheets

HIGH-STRENGTH COLD-ROLLED STEEL SHEET EXCELLENT IN BENDING WORKABILITY

TECHNICAL FIELD

The present invention relates to high-strength cold-rolled steel sheets excellent in bending workability. Specifically, it relates to high-strength cold-rolled steel sheets and, more specifically, relates to cold-rolled steel sheets with tensile strength on the order of 880 MPa or more.

BACKGROUND ART

Steel sheets for automobiles are intended to have higher strength in consideration of safety of the automobiles and environmental issues. In general, the workability of a steel sheet decreases with an increasing strength thereof. However, a variety of steel sheets having both high strength and satisfactory workability have been developed and become commercially practical. For example, a steel sheet having a composite structure including a ferrite phase in coexistence with one or more low-temperature transformation phases such as martensite and bainite phases is used as a high-strength steel sheet excellent in workability. The steel sheet having the composite structure is designed to improve both the strength and workability by dispersing a hard low-temperature transformation phase in a soft ferrite matrix. Such steel sheets having a composite structure, however, suffer from work fracture starting from inclusions.

Under these circumstances, there have been proposed techniques for improving the workability by controlling inclusions. Typically, Japanese Patent No. 3845554 describes that a cold-rolled steel sheet excellent in bending workability is obtained by controlling the number of inclusions to 25 or less per square millimeter ($mm^2$), which inclusions have diameters in terms of corresponding circles of 5 μm or more. Japanese Unexamined Patent Application Publication (JP-A) No. 2005-272888 describes that a highly ductile cold-rolled steel sheet is obtained by controlling the number of oxide inclusions to 35 or less per square centimeter ($cm^2$) in a silicon-deoxidized steel, which oxide inclusions have minor axes of 5 μm or more. This literature also mentions that inclusions are finely divided by controlling the composition of inclusions to one which is liable to expand and break. However, even when individual inclusions are finely divided and dispersed at a low number density as in the techniques disclosed in the two literatures, fracture or cracking starting from inclusions may occur in some distributions of the inclusions. Further investigations are needed so as to reliably increase the workability, especially bending workability necessary in steel sheets for automobiles. The technique disclosed in Japanese Patent No. 3845554 requires the steel to be a low-sulfur steel, and this leads to increased cost. Japanese Unexamined Patent Application Publication (JP-A) No. 2005-272888 does not refer to the bending workability necessary in steel sheets for automobiles, among such workabilities.

Independently, Japanese Patent No. 3421943 describes that can-making (plate working) failure of a cold-rolled steel sheet for cans is reduced by controlling the abundance of dot-sequential inclusions to the range from 6003 per square meter ($m^2$) to $2\times10^4$ per square meter, in which the dot-sequential inclusions are observed in an arbitrary cross section in parallel with a rolling plane of the steel sheet. The dot-sequential inclusions herein are a group of three or more oxide inclusions that are arranged linearly at intervals of less than 200 μm in parallel with the rolling direction. The steel disclosed in the literature, however, is adopted only to cans and needs drawing workability. However, the literature does not consider the bending workability needed when used as a steel sheet for automobiles.

Technical Problem

As is mentioned above, known high-strength steel sheets with less defects caused by inclusions are obtained mainly by strictly controlling the sizes, numbers (number densities), and/or amounts of individual inclusions. However, the known steel sheets, when subjected to bending, may suffer from fracture which is generated sporadically even under significantly mild working conditions. This lowers the productivity and causes increased cost typically for performing product inspection.

Under these circumstances, an object of the present invention is to provide a high-strength cold-rolled steel sheet which has a sufficiently minimized rate of bending fracture starting from inclusions and thereby has excellent bending workability.

Solution to Problem

Specifically, the present invention provides a cold-rolled steel sheet containing a steel sheet having a composition of, a carbon (C) content of 0.12 to 0.3 percent by mass (hereinafter contents will be simply expressed in "%"), a silicon (Si) content of 0.5% or less, a manganese (Mn) content of less than 1.5%, an aluminum (Al) content of 0.15% or less, a nitrogen (N) content of 0.01% or less, a phosphorus (P) content of 0.02% or less, and a sulfur (S) content of 0.01% or less, with the remainder including iron and inevitable impurities, in which the steel sheet has a martensite single-phase structure as its steel microstructure, and, in a surface region from a surface to a depth one-tenth the gauge of the steel sheet, the number density of n-ary groups of inclusions is 120 or less per 100 $cm^2$ of a rolling plane, in which each of the n-ary groups of inclusions is determined by an n-th determination mentioned below, and, in each of the n-ary groups of inclusions, the distance in a steel sheet rolling direction between outermost surfaces of two outermost particles of the n-ary group of inclusions is 100 μm or more:

n-th Determination the "n-ary group of inclusions" refers to a group of inclusions which includes an (n−1)-ary group of inclusions (wherein "n" is an integer of 1 or more; when "n" is 1, a "zero-ary group of inclusions" refers to an inclusion particle) and at least one neighboring x-ary group of inclusions (wherein "x" is an integer of from 0 to n−1, where "n" is an integer of 1 or more; a "zero-ary group of inclusions" refers to an inclusion particle), in which the minimum intersurface distance (λ) of nearest neighbor particles between the (n−1)-ary group of inclusions and the x-ary group of inclusions satisfies a condition represented by following Expression (1) and is 60 μm or less:

$$\lambda \leq 4.0\times10^5\left(\frac{1}{\sigma_y}\right)^2(d_1+d_2) \tag{1}$$

wherein:

λ represents the minimum intersurface distance (μm) of nearest neighbor particles between the (n−1)-ary group of inclusions and the x-ary group of inclusions;

$\sigma_y$ represents the yield strength (MPa) of the steel sheet;

$d_1$ represents the particle size (μm), in a steel sheet rolling direction, of the (n−1)-ary group of inclusions when "n" is 1, or represents the distance (μm), in the steel sheet rolling direction, between outermost surfaces of two outermost particles of the (n−1)-ary group of inclusions when "n" is 2 or more; and $d_2$ represents the particle size (μm), in a steel sheet rolling direction, of the x-ary group of inclusions when "x" is 0, or represents the distance (μm); in the steel sheet rolling direction, between outermost surfaces of two outermost particles of the x-ary group of inclusions when "x" is 1 or more.

The steel sheet according to the present invention may further contain, as additional element(s), (A) chromium (Cr) in a content of 2% or less and/or boron (B) in a content of 0.01% or less;

(B) at least one element selected from the group consisting of copper (Cu) in a content of 0.50 or less, nickel (Ni) in a content of 0.5% or less, and titanium (Ti) in a content of 0.2% or less; and/or (C) vanadium (V) in a content of 0.1% or less and/or niobium (Nb) in a content of 0.10 or less.

The present invention further provides a hot-dip galvanized steel sheet including the cold-rolled steel sheet and a hot-dip galvanized coating formed on the cold-rolled steel sheet through hot-dip galvanization; and a hot-dip galvannealed steel sheet including the cold-rolled steel sheet, and a hot-dip galvannealed coating formed on the cold-rolled steel sheet through hot-dip galvanization and subsequent alloying.

The present invention reliably gives high-strength cold-rolled steel sheets excellent in bending workability, which are usable as steel sheets for automobiles. Specifically, the present invention provides steel sheets which are suitable for the manufacture typically of bumping parts such as bumpers and front and rear side members; and body-constituting parts including pillar parts such as center pillar reinforcing members.

DESCRIPTION OF EMBODIMENTS

The present inventors made intensive investigations in consideration that fracture is generated during processing (particularly during bending) even when the chemical compositions of individual inclusion particles are controlled. As a result, the present inventors initially obtained the following findings (1) and (2):

(1) Bending fracture starts from a group of inclusions which are distributed dot-sequentially in parallel with the steel sheet rolling direction.

(2) Even when individual inclusion particles configuring the group of inclusions are finely divided as specified in known technologies, such as one disclosed in Japanese Patent No. 3845554, these individual inclusion particles form a group of inclusions in a dot-sequential distribution, thereby allow voids generated in the vicinity of the individual inclusion particles to coalesce with each other into a defect (void) during processing; and the resulting defect (void) is more coarse and more flat as compared to a void generated in the vicinity of an inclusion particle existing alone. The coarse and flat defect (void) probably receives very large stress concentrated thereon during bending, as compared to the void generated in the vicinity of an inclusion particle existing alone, and this may readily cause the fracture of the steel.

Based on these findings, the present inventors have investigated which specific distribution of inclusion particles causes the coarse and flat defect (void). As a result, the present inventors have initially found that two inclusion particles behave as a group of inclusions causing one huge defect when the distribution (locational relationship) of the two inclusion particles satisfies following Expression (1). Expression (1) is based on the reasoning that "to allow a void generated around an individual inclusion particle to coalesce with a neighboring void, a material present between the two voids should plastically deform," and has been experimentally obtained in consideration of a plastic deformation area caused by the stress concentration in the vicinity of the defect.

$$\lambda \leq 4.0 \times 10^5 \left(\frac{1}{\sigma_y}\right)^2 (d_1 + d_2) \tag{1}$$

In Expression (1):

λ represents the minimum intersurf ace distance (μm) between an arbitrary inclusion particle and an inclusion particle neighboring thereto;

$\sigma_y$ represents the yield strength (MPa) of the steel sheet;

$d_1$ represents the particle size (μm) of the arbitrary inclusion particle in a steel sheet rolling direction; and $d_2$ represents the particle size (μm) of the neighboring inclusion particle to the arbitrary inclusion in the steel sheet rolling direction.

Figure 1:
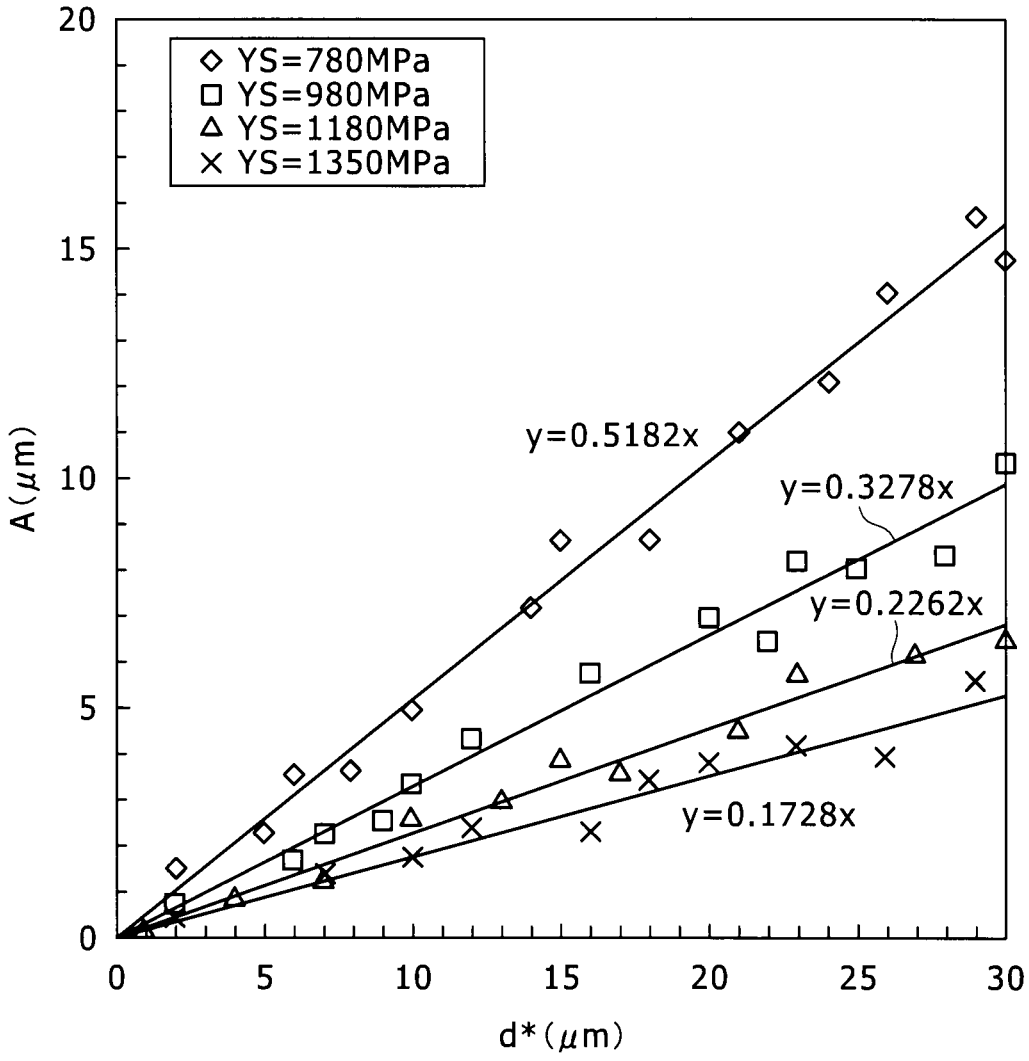
FIG. 1 is a graph illustrating how a void growth area (A) varies depending on an actual particle size of inclusion (d*) at different yield strengths (YS) of steel sheets.

Expression (1) was deduced in the following manner. In samples in an experimental example mentioned later, inclusion particles in a fracture surface were observed; actual diameters (actual sizes) (d*) of the inclusion particles and diameters (D) of voids generated around the inclusion particles, respectively, were measured, from which how a void growth area (A=(D−d*)/2) varies depending on the actual size of the inclusion particle (d*) was grasped. The grasped relation between the actual particle size of inclusion (d*) and the void growth area (A) at different yield strengths (YS=780 MPa, 980 MPa, 1180 MPa, and 1350 MPa) of steel sheets is shown in FIG. 1. The results obtained from FIG. 1 are sorted out by the yield strength (YS=$\sigma_y$) of steel sheet and lead to following Expression (2):

$$A = 3.18 \times 10^5 \left(\frac{1}{\sigma_y}\right)^2 d^* \quad (2)$$

In general, the relation between the particle size (d) and actual particle size (d*) of an inclusion observed in an arbitrary plane is expressed by following Expression (3):

$$d = 1.27d \quad (3)$$

The void growth area (A) is expressed by following Expression (4) based on Expressions (2) and (3):

$$A = 4.0 \times 10^5 \left(\frac{1}{\sigma_y}\right)^2 d \quad (4)$$

Accordingly, the present inventors deduced Expression (1) based on a reasoning that voids coalesce with each other when the total of void growth areas ($A_1$+$A_2$) of two neighboring inclusion particles having particle sizes of $d_1$ and $d_2$, respectively, is equal to or more than the minimum intersurface distance (λ) of the two inclusion particles.

In addition, the minimum intersurface distance (λ) of the two inclusion particles is herein specified to be 60 μm or less. This is because, if the minimum intersurface distance (λ) is more than 60 μm, the correlation between the number density of specific groups of inclusions and the rate of bending fracture caused by specific groups of inclusions mentioned below is low. By specifying the minimum intersurface distance (λ) to be 60 μm or less, the cost is prevented from increasing as compared to the known technologies in which control is needed even when the distance between inclusion particles is excessively large.

Figure 2A:
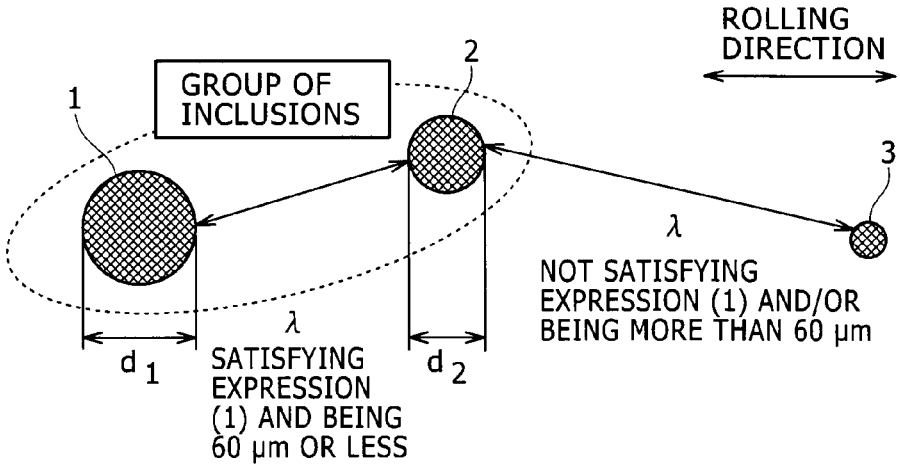
FIGS. 2A and 2B are diagrams illustrating exemplary configurations of primary groups of inclusions.

A group of the two inclusion particles which has a minimum intersurface distance (λ) satisfying Expression (1) and being 60 μm or less is defined in the present invention as a "group of inclusions" which forms a coarse and flat defect (void) during bending. The group of inclusions is schematically illustrated in FIG. 2A. FIG. 2A demonstrates that an inclusion particle 3 on the far-right portion of the figure does not constitute a group of inclusions with an inclusion particle 2, because the minimum intersurface distance (λ) between the inclusion particle 3 and the inclusion particle 2 does not satisfy Expression (1) and/or is more than 60 μm.

In the above illustration, $d_1$ and $d_2$ are described as in the case where the two objects are inclusion particles, respectively. However, when the group of inclusions composed of two inclusion particles is assumed to be one inclusion particle, a further large group of inclusions may be formed between the assumed inclusion particle (group of inclusions) and a neighboring inclusion particle or neighboring another group of inclusions when the minimum intersurface distance (λ) between the two satisfies Expression (1) and is 60 μm or less. Accordingly, there is a need of performing one or more further determinations (second or later determinations) to determine whether the minimum intersurface distance (λ) between the group of inclusions composed of two inclusion particles and a neighboring inclusion particle or neighboring another group of inclusions satisfies Expression (1) and is 60 μm or less.

The "groups of inclusions" in the present invention may be specified by repeating determinations of groups of inclusions, such as first, second, etc., and n-th determinations step by step. The determinations are performed so as to determine whether two inclusion particles or two groups of inclusions satisfy the conditions (i.e., the minimum intersurface distance (λ) between the two satisfies Expression (1) and is 60 μm or less) and thereby constitute a new group of inclusions.

The determination is repeated until neither inclusion particle nor group of inclusions is present in the neighborhood of a group of inclusions, in which the minimum intersurface distance (λ) between the two satisfies Expression (1) and is 60 μm or less. The finally determined group of inclusions is counted as one group of inclusions.

Figure 3A:
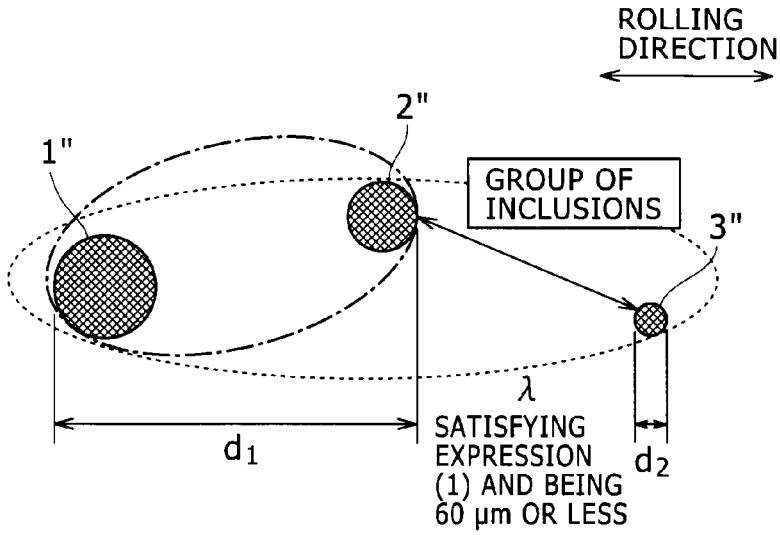
FIGS. 3A and 3B are diagrams illustrating exemplary configurations of secondary groups of inclusions.

For example, a group of inclusions composed of three inclusion particles (1", 2", and 3") is illustrated in FIG. 3A mentioned below. This group of inclusions is a secondary group of inclusions composed of a primary group of inclusions and an inclusion particle 3." The primary group of inclusions contains two inclusion particles 1" and 2" which are determined to satisfy the above conditions and to constitute a group of inclusions (primary group of inclusions) in the first determination. The inclusion particle 3" is determined in the second determination to satisfy the above conditions with the primary group of inclusions and to constitute the secondary group of inclusions. In this case, the number of group of inclusions is counted not as "two" groups of inclusions but as "one" (secondary) group of inclusions composed of the inclusion particle 1", 2" and 3" determined as a group of inclusions in the second determination. In the "two" groups of inclusions, the primary group of inclusions composed of two inclusion particles (1" and 2") is counted separately from the secondary group of inclusions composed of three inclusion particles (1", 2", and 3").

Specifically, a group of inclusions may be determined step by step typically in the following manner, in which determinations of group of inclusions up to third determination are illustrated in detail.

(i) First Determination (Determination of Primary Group of Inclusions)

When the minimum intersurf ace distance (λ) between or among at least two inclusion particles satisfies Expression (1) and is 60 μm or less, a group of inclusions composed of these inclusion particles is defined as a "primary group of inclusions," as schematically illustrated in FIG. 2A.

Figure 2B:
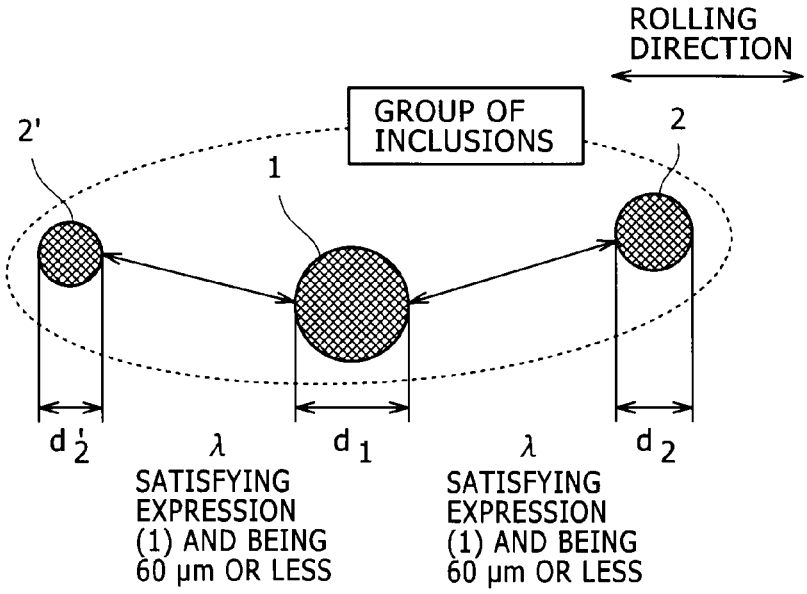

When an inclusion particle 1 satisfies the conditions (the minimum intersurf ace distance (λ) satisfies Expression (1) and is 60 μm or less) not only with an inclusion particle 2 but also with an inclusion particle 2', a group of inclusions composed of these inclusion particles 1, 2, and 2' is defined as a "primary group of inclusions", as is illustrated in FIG. 2B.

(ii) Second Determination (Determination of Secondary Group of Inclusions)

(ii -1) When the minimum intersurface distance (λ) satisfies Expression (1) and is 60 μm or less between the primary group of inclusions and at least one neighboring inclusion particle, a group of inclusions composed of these is defined as a "secondary group of inclusions." The secondary group of inclusions is schematically illustrated in FIG. 3A.

Figure 3B:
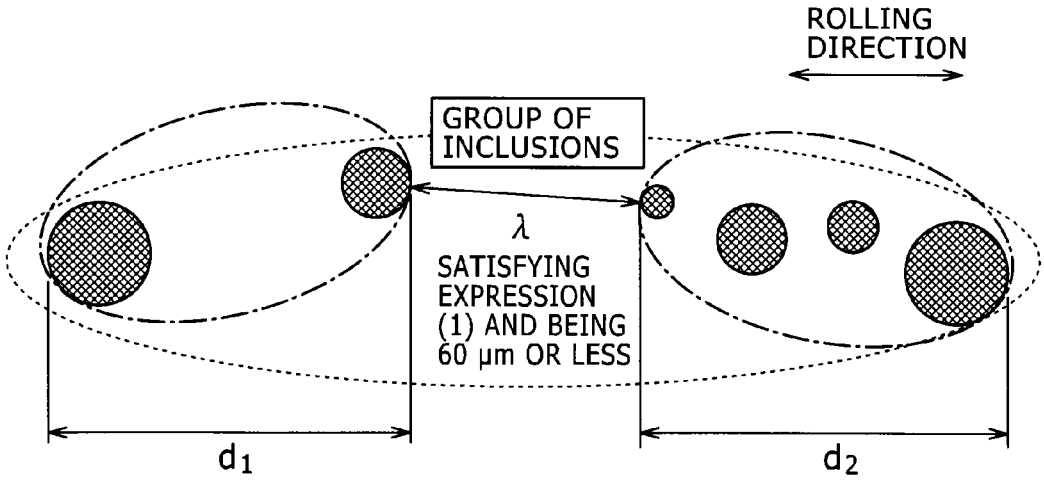

(ii-2) When the minimum intersurface distance (λ) satisfies Expression (1) and is 60 μm or less between the primary group of inclusions and at least one neighboring other primary group of inclusions, a group of inclusions composed of these is defined as a "secondary group of inclusions." This secondary group of inclusions is schematically illustrated in FIG. 3B.

(iii) Third Determination (Determination of Tertiary Group of Inclusions)

(iii-1) When the minimum intersurface distance (λ) satisfies Expression (1) and is 60 μm or less between the secondary group of inclusions and at least one neighboring inclusion particle, a group of inclusions composed of these is defined as a "tertiary group of inclusions."

(iii-2) When the minimum intersurface distance (λ) satisfies Expression (1) and is 60 μm or less between the secondary group of inclusions and at least one neighboring primary group of inclusions, a group of inclusions composed of these is defined as a "tertiary group of inclusions."

(iii-3) When the minimum intersurface distance (λ) satisfies Expression (1) and is 60 μm or less between the secondary group of inclusions and at least one neighboring other secondary group of inclusions, a group of inclusions composed of these is defined as a "tertiary group of inclusions."

The same procedure is continued on a fourth determination (determination of quaternary group of inclusions) and later.

An arbitrary group of inclusions (n-ary group of inclusions) is determined in an n-th ("n" is an integer of 1 or more) determination according to the above determination procedure. This arbitrary group of inclusions (n-ary group of inclusions) may be indicated as follows.

Specifically, the n-ary group of inclusions refers to a group of inclusions composed of an (n−1)-ary group of inclusions (wherein "n" is an integer of 1 or more; when "n" is 1, a "zero-ary group of inclusions" refers to an inclusion particle) and at least one neighboring x-ary group of inclusions (wherein "x" is an integer of from 0 to n−1, where "n" is an integer of 1 or more; a "zero-ary group of inclusions" refers to an inclusion particle), in which the distance of nearest neighbor particles between the (n−1)-ary group of inclusions and the x-ary group of inclusions (hereinafter briefly referred to as "minimum intersurface distance (λ)") satisfies following Expression (1) and is 60 μm or less.

$$\lambda \leq 4.0 \times 10^5 \left(\frac{1}{\sigma_y}\right)^2 (d_1 + d_2) \quad (1)$$

In Expression (1):

λ represents the minimum intersurface distance (μm) of nearest neighbor particles between the (n−1)-ary group of inclusions and the x-ary group of inclusions;

$\sigma_y$ represents the yield strength (MPa) of the steel sheet;

$d_1$ represents the particle size (μm), in a steel sheet rolling direction, of the (n−1)-ary group of inclusions when "n" is 1, or represents the distance (μm), in the steel sheet rolling direction, between outermost surfaces of two outermost particles of the (n−1)-ary group of inclusions when "n" is 2 or more; and $d_2$ represents the particle size (μm), in a steel sheet rolling direction, of the x-ary group of inclusions when "x" is 0, or represents the distance (μm), in the steel sheet rolling direction, between outermost surfaces of two outermost particles of the x-ary group of inclusions when "x" is 1 or more.

As used herein the term "determined by an n-th determination" refers to that the determination procedure is repeated until neither inclusion particle nor group of inclusions is present in the neighborhood of a group of inclusions, in which the minimum intersurface distance (λ) between the two satisfies Expression (1) and is 60 μm or less; and ultimately one group of inclusions is determined, as is described above.

In the determination, the lower limit of the particle size, in the steel sheet rolling direction, of inclusion particles to be determined is about 0.5 μm.

Major Axis of Group of Inclusions

Figure 4:
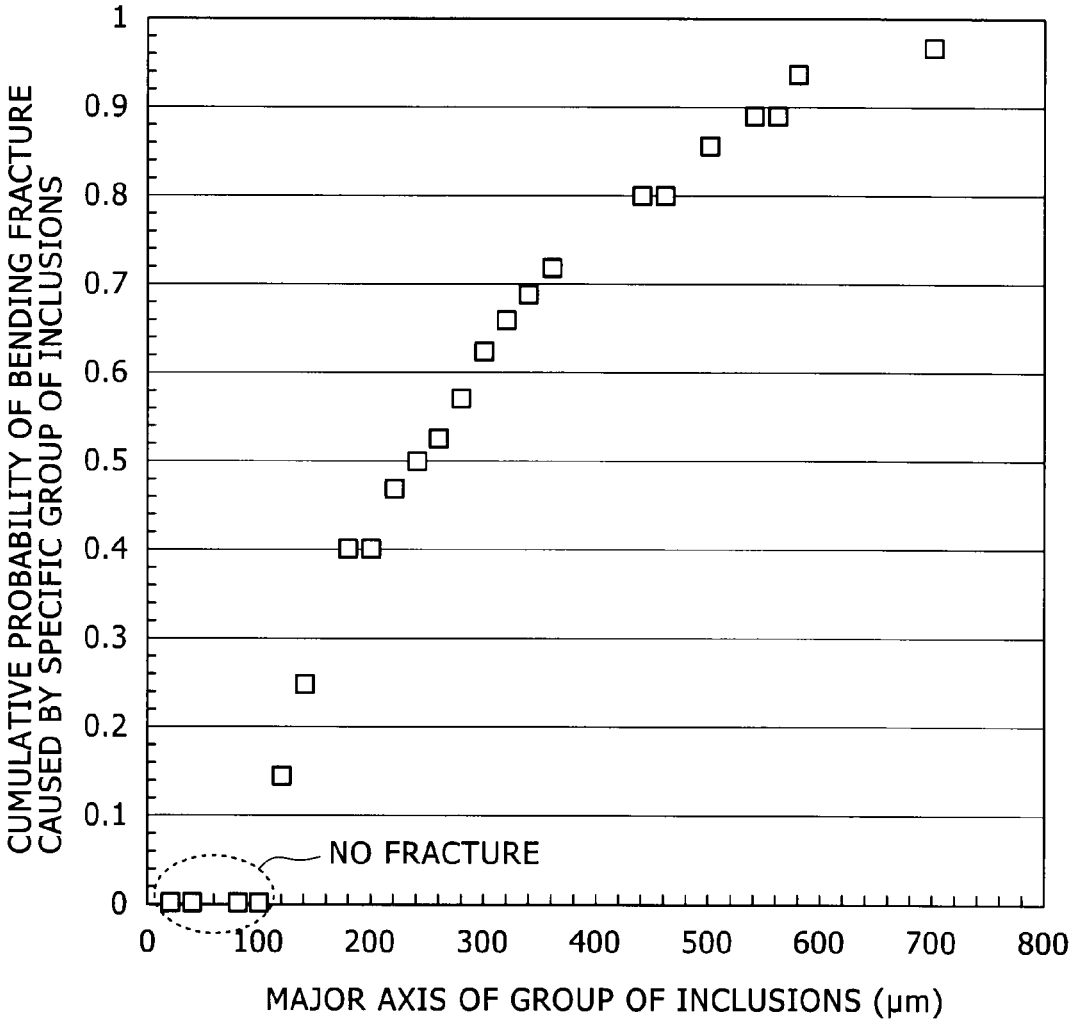
FIG. 4 is a graph showing how the cumulative probability of bending fracture caused by specific groups of inclusions varies depending on the major axes of the specific groups of inclusions.

The influence of a thus-determined group of inclusions on the bending workability varies depending on the size of the group of inclusions. The present inventors have made investigations to verify how the bending workability (rate of bending fracture caused by specific groups of inclusions) varies depending on the size of the group of inclusions. As used herein the "size" of a group of inclusions refers to the major axis of the group of inclusions, i.e., the distance in the steel sheet rolling direction between outermost surfaces of two outermost particles of the group of inclusions (hereinafter also referred to as "intersurface distance"). FIG. 4 is a graph showing how the cumulative probability of bending fracture caused by specific groups of inclusions varies depending on the major axes of the specific groups of inclusions. Specifically, in samples in the after-mentioned experimental example, fractured surfaces of samples undergoing fracture starting from groups of inclusions were observed; and major axes of the fracture-causing groups of inclusions in a steel sheet rolling direction were measured. The numbers of groups of inclusions having major axes of, for example, 20 μm or more and less than 40 μm, of 40 μm or more and less than 60 μm, of 60 μm or more and less than 80 μm, etc., were counted as groups of inclusions having major axes of 20 μm, 40 μm, 60 μm, etc., respectively; and the cumulative probability of bending fracture caused by specific groups of inclusions was plotted against the major axes at intervals of 20 μm. The cumulative probability is expressed by proportion (rate), and the cumulative probability, when being 1, means that the rate of bending fracture is 100%.

FIG. 4 demonstrates that fracture is caused by a group of inclusions (cumulative probability is more than 0) when the group of inclusions has a major axis of 100 μm or more. Accordingly, the lower limit of the major axis of a group of inclusions to be controlled according to the present invention is set to be 100 μm. A group of inclusions having a major axis of 100 μm or more is hereinafter also referred to as a "specific group of inclusions."

Observation Area

An observation area in the present invention is specified by the following measurement based on the fact that a region where the specific group of inclusions remarkably causes bending fracture is a surface region of the steel sheet which receives a large strain particularly during bending. Specifically, using sample steel sheets in the after-mentioned experimental example, a hot spot of defects (position of inclusions) in the rolling plane was previously determined through ultrasonic inspection at frequencies of 30 MHz and 50 MHz. Bending was then performed according to the procedure in the after-mentioned experimental example so that the bending edge line was in parallel with the rolling direction and agreed with the above-determined hot spot of defects (position of inclusions).

As for specimens which had undergone fracture as a result of bending, fracture surfaces at the fracture starting points were observed. After determining whether any specific group of inclusions was present or not, the position (depth from the surface) of the specific group of inclusions, if present, was measured. Independently, specimens which had not undergone fracture were ground from the hot spot of defects in the rolling plane to a depth of 0.5 t (t: gauge) in a thickness direction, and whether any specific group of inclusions was present in a range from the surface to 0.5t deep was determined.

Next, the probability (%) of a specific group of inclusions to cause bending fracture was determined according to the following Expression (5) at different measurement positions. It should be noted that this probability is distinguished from a "rate of bending fracture caused by specific groups of inclusions" mentioned later.

Probability (%) of a specific group of inclusions to cause bending fracture=100×(Number of specimens undergoing bending fracture and containing at least one specific group of inclusions)/[(Number of specimens undergoing bending fracture and containing at least one specific group of inclusions)+(Number of specimens undergoing no bending fracture and containing at least one specific group of inclusions) (5)

Figure 5:
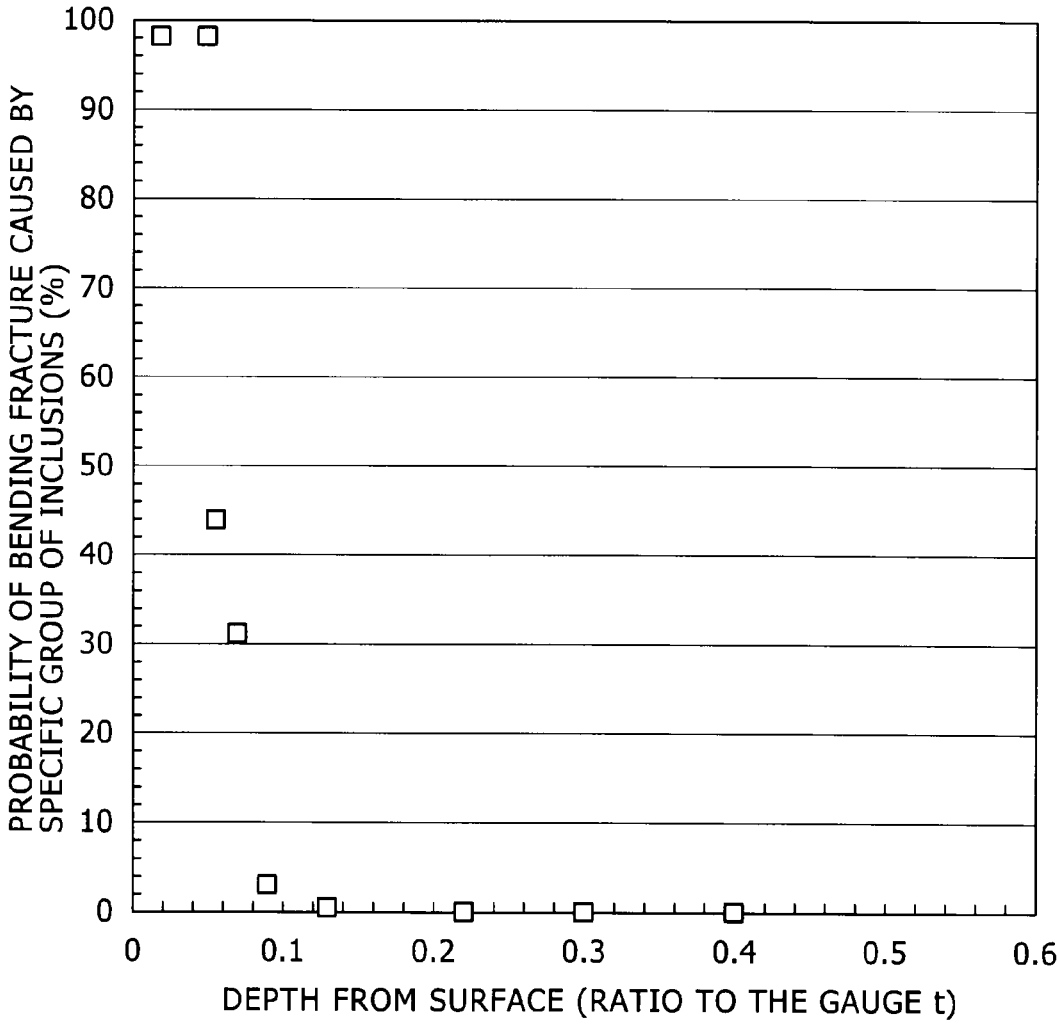
FIG. 5 is a graph showing how the probability of bending fracture caused by specific groups of inclusions varies depending on the positions (depth) of the specific groups of inclusions from the surface of steel sheet (ratio to the gauge t)

The results are sorted out and are shown in FIG. 5. In FIG. 5, data of 0.02 t (the ratio of the depth to the gauge t is 0.02), of 0.04 t, of 0.06 t, etc. are data summarized from measured results in regions of from the surface (depth 0 mm) to a depth of 0.02 t, of from a depth of more than 0.02 t to a depth of 0.04 t, of from a depth of more than 0.04 t to a depth of 0.06 t, etc., respectively. FIG. 5 demonstrates that a specific group of inclusions herein causes bending fracture when the specific group of inclusions is present in a range of from the surface to a depth of (gauge)×0.1 (0.1 t) of the steel sheet; and the bending workability is significantly affected by the surface region. Accordingly, the observation area (area to be observed) is herein set to a range from the surface to a depth of (gauge×0.1) (one-tenth the gauge) of the steel sheet.

Figure 6:
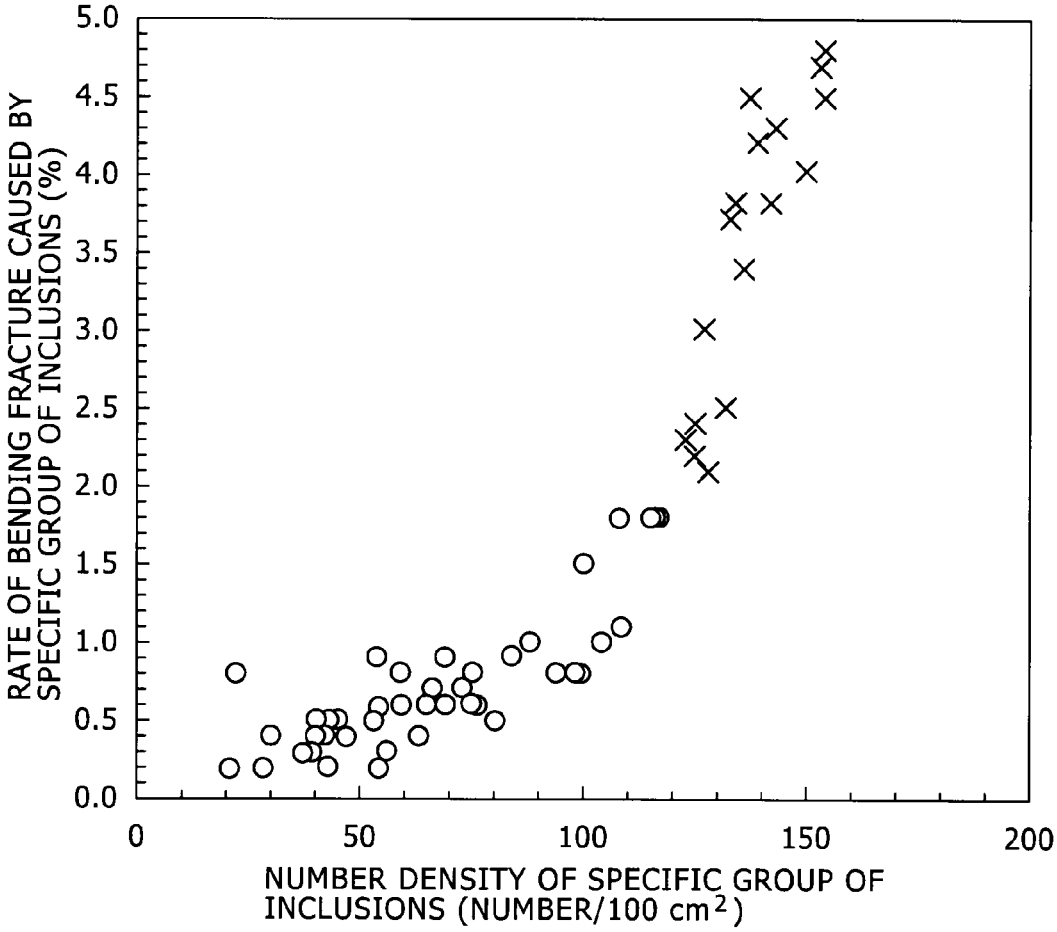
FIG. 6 is a graph showing how the rate of bending fracture caused by specific groups of inclusions varies depending on the number density of the specific groups of inclusions.

Relation Between Number Density of Specific Groups of Inclusions and Bending Workability Next, the present inventors investigated how the bending workability (rate of bending fracture caused by specific groups of inclusions) varies depending on the number density of specific groups of inclusions. FIG. 6 depicts a graph illustrating how the rate of bending fracture caused by specific groups of inclusions varies depending on the number density of specific groups of inclusions. The data were determined according to the technique described in the after-mentioned experimental example. Independently, it has been verified that steel sheets having rates of bending fracture caused by specific groups of inclusions of 2.0% or less show no problems as actual products.

Data given in FIG. 6 demonstrate that the number density of specific groups of inclusions should be controlled to be 120 or less per 100 $cm^2$ of a rolling plane to achieve a rate of bending fracture caused by specific groups of inclusions of 2.0% or less. The number density is preferably 100 or less per 100 $cm^2$ of a rolling plane.

The measurement of the specific group(s) of inclusions may be performed, for example, in the visual observation under an optical microscope of 100 magnifications as described in the after-mentioned experimental example. The measurement can also be performed automatically by binarizing the results in the observation under the optical microscope and subjecting the binarized data to an image analysis in which conditions such as Expression (1) and the boundary value (60 μm) of the minimum intersurface distance (λ) are previously set.

The present invention specifies that the shape or form of a group of inclusions should satisfy the above conditions, but do not specify the compositions of individual inclusion particles constituting the group of inclusions. Exemplary inclusion particles are oxide inclusions containing, for example, one or more of Al, Si, Mn, Ca, and Mg; sulfide inclusions containing, for example, Mn and/or Ti; and composite inclusions of these inclusions. In this connection, Ca and Mg may be contained in inclusions as derived from the furnace wall or due to involution of slag although these are not added as selective elements herein. When any of Ca, Mg, and rare-earth elements (REMs) is contained in the steel as selective elements, the steel may contain oxide inclusions and sulfide inclusions (such as sulfide inclusions containing Ca and/or Mg) each containing these elements.

Inclusions are controlled as groups of inclusions according to the present invention, as described above. In addition, the total number of inclusion particles in the steel sheet is preferably reduced or minimized as in known techniques. Specifically, the number of inclusion particles having particle sizes of 5 μm or more in the steel sheet rolling direction is preferably controlled to be 25 or less per square millimeter ($mm^2$).

Steel Structure

A cold-rolled steel sheet according to the present invention, when used typically as a steel sheet for automobiles, needs both higher strength (in terms of tensile strength of 880 MPa or more, preferably 980 MPa or more) and satisfactory workability. A steel sheet, if containing an excessively large amount of ferrite structure, may be difficult to ensure such high strength. A steel sheet, if containing a composite structure, may be difficult to develop sufficiently satisfactory bending workability (particularly critical bending workability). The bending workability (particularly critical bending workability) is improved according to the present invention by allowing the steel sheet to have a martensite single-phase structure. The martensite structure preferably contains tempered martensite.

As used herein the term "martensite single-phase structure" means that the martensite structure occupies 94 percent by area or more (more preferably 95 percent by area or more, and especially preferably 97 percent by area) of the steel structure. The steel sheet may contain, in addition to the martensite structure, any structure inevitably contained during manufacturing process, such as ferrite structure, bainite structure, and retained austenite structure. The martensite structure may occupy 100 percent by area of the cold-rolled steel structure.

The steel sheet should have a chemical composition satisfying the following conditions so as to sufficiently exhibit effects of the structure control, including the form of inclusions, so as to increase the bending workability reliably and to be a steel sheet having high strength and excellent workability in good balance. The steel sheet is recommended to be manufactured under manufacturing conditions mentioned later. Initially, the chemical composition of the steel sheet will be illustrated in detail below.

Chemical Composition of Steel Sheet

Carbon (C) content: 0.12% to 0.3%

Carbon (C) element is necessary for increasing the hardenability so as to ensure high strength of the steel sheet; and the carbon content should therefore be 0.12% or more, and is preferably 0.15% or more. However, the steel sheet, if containing carbon in excess, may be worsen in spot weldability and toughness or may often suffer from delayed fracture in a quenched area. The carbon content should therefore be 0.3% or less and is preferably 0.26% or less.

Silicon (Si) content: 0.5% or less

Silicon (Si) element is effective for increasing resistance to temper softening and is also effective for improving the strength due to solid-solution strengthening. From these viewpoints, the Si content is preferably 0.02% or more. The silicon element, however, also invites the formation of ferrite, and, if contained in excess, may adversely affect the hardenability and impede insurance of high strength. The Si content should therefore be 0.5% or less and is preferably 0.4% or less.

Manganese (Mn) content: less than 1.5%

Manganese (Mn) element is effective for improving the hardenability so as to increase the strength of the steel sheet. However, Mn, if contained in excess, may adversely affect the bonding strength of weld beads (e.g., seam weld beads and spot weld beads) and causes the formation of hard phases such as martensite and bainite phases during cooling after hot rolling. This causes the hot-rolled steel sheet to have excessively high strength to thereby have a low reduction ratio in cold rolling. For these reasons, the Mn content is less than 1.5%, preferably 1.4% or less, and more preferably 1.3% or less. The Mn content is preferably 0.1% or more.

Aluminum (Al) content: 0.15% or less

Aluminum (Al) element is added as a deoxidizer and has an activity of improving the corrosion resistance of the steel. The Al content is preferably 0.05% or more in order to exhibit these effects sufficiently. However, this element, if contained in excess, may form large amounts of carbon-based inclusions to cause surface flaw. To avoid this, the Al content should be 0.15%, is preferably 0.10% or less, and more preferably 0.07% or less.

Nitrogen (N) content: 0.01% or less

Nitrogen (N), if contained in excess, may precipitate as nitrides in larger amounts to thereby adversely affect the toughness. To avoid this, the nitrogen content should be 0.01% or less and is preferably 0.008% or less. The nitrogen content is generally 0.001% or more in consideration typically of the cost for steel making.

Phosphorus (P) content: 0.02% or less

Phosphorus (P) element acts to strengthen the steel but lowers the ductility thereof due to brittleness. The phosphorus content should therefore be controlled to 0.02% or less and is preferably 0.01% or less.

Sulfur (S) content: 0.01% or less

Sulfur (S) element forms sulfide inclusions to thereby worsen the workability and weldability of the steel sheet. To avoid this, the sulfur content is preferably minimized and should be controlled to be 0.01% or less in the present invention. The sulfur content is preferably 0.005% or less, and more preferably 0.003% or less.

The basic composition of the steel sheet specified in the present invention is as mentioned above, and the remainder includes iron and inevitable impurities. The steel sheet may contain, as the inevitable impurities, elements brought typically from raw materials, construction materials, and manufacturing facilities. The steel sheet may further positively contain the following elements within ranges not adversely affecting the operation of the present invention.

(A) Cr in a content of 2% or less and/or B in a content of 0.01% or less

Chromium (Cr) and boron (B) elements are both effective for improving the hardenability so as to increase the strength of the steel sheet. The Cr element is also effective for improving the resistance to temper softening of steel having a martensite structure. To exhibit these effects sufficiently, the Cr content is preferably 0.01% or more and more preferably 0.05% or more; and the boron content is preferably 0.0001% or more, more preferably 0.0005% or more, furthermore preferably 0.0010% or more, and especially preferably 0.003% or more. Chromium, if contained in excess, may worsen the resistance to delayed fracture. Boron, if contained in excess, may adversely affect the ductility of the steel. To avoid these, the Cr content is preferably 2% or less and more preferably 1.7% or less, and the boron content is preferably 0.01% or less and more preferably 0.008% or less.

(B) At least one element selected from the group consisting of copper (Cu) in a content of 0.5% or less, nickel (Ni) in a content of 0.5% or less, and titanium (Ti) in a content of 0.2% or less Copper (Cu), nickel (Ni), and titanium (Ti) elements are effective for improving the corrosion resistance of the steel to thereby improve the resistance to delayed fracture. These effects are effectively exhibited particularly in steel sheets having tensile strengths of more than 980 MPa. The Ti element is also effective for improving the resistance to temper softening. To exhibit these effects sufficiently, the Cu content is preferably 0.01% or more and more preferably 0.05% or more; the Ni content is preferably 0.01% or more and more preferably 0.05% or more; and the Ti content is preferably 0.01% or more and more preferably 0.05% or more. However, these elements, if contained in excess, mayworsen the ductility and/or workability. To avoid this, the Cu and Ni contents are each preferably 0.5% or less, and the Ti content is preferably 0.2% or less regarding the upper limits. The Cu and Ni contents are each more preferably 0.4% or less; and the Ti content is more preferably 0.15% or less.

(C) Vanadium (V) in a content of 0.1% or less and/or niobium (Nb) in a content of 0.1% or less Vanadium (V) and niobium (Nb) elements are each effective for improving the strength and for finely dividing austenite grains (gamma grains) to thereby improve the toughness after quenching. To exhibit these effects sufficiently, the vanadium content and niobium content are each preferably 0.003% or more and more preferably 0.02% or more. However, these elements, if contained in excess, may cause increased amounts of precipitates such as carbonitrides to thereby worsen the workability and resistance to delayed fracture. To avoid this, the vanadium content and niobium content are each preferably 0.1% or less and more preferably 0.05% or less.

To further improve the corrosion resistance and/or the resistance to delayed fracture, the steel may contain a total of 0.01% or less of one or more additional elements. Examples of additional elements include Se, As, Sb, Pb, Sn, Bi, Mg, Zn, Zr, W, Cs, Rb, Co, Tl, In, Be, Hf, Tc, Ta, O, Ca, and rare-earth elements (e.g., Y, La, Ce, and Nd).

The present invention fully exhibits advantageous effects thereof when applied to high-strength steel sheets having tensile strengths of 880 MPa or more, and especially preferably 980 MPa or more.

Though the present invention does not specify the manufacturing method of the steel sheet, it is recommended to control the total rolling reduction of a rolling reduction at temperatures of about 950° C. or lower in hot rolling and a rolling reduction in cold rolling (cold rolling reduction). The control is preferred for achieving the specific form of inclusions. As used herein the term "total rolling reduction" refers to a rolling reduction determined from the gauge of the steel sheet at 950° C. and the gauge of the steel sheet upon the completion of cold rolling according to following Expression (6):

$$\text{Total Rolling Reduction (\%)}=[((\text{Gauge of steel sheet at } 950^\circ\text{ C})-(\text{Gauge of steel sheet upon completion of cold rolling}))/((\text{Gauge of steel sheet at } 950^\circ\text{ C.})]\times 100 \quad (6)$$

Though the compositions of inclusion particles are not specified herein as described above, inclusions in the steel sheet according to the present invention are often mainly composed of oxide inclusions; and the oxide inclusions can be crushed and dispersed to form a specific group of inclusions during rolling performed at relatively low temperatures where the steel has a lower plastic deformation ability. The resulting finely divided and widely dispersed group of inclusions causes a huge and flat defect (void) upon bending, and large stress concentrates in the vicinity of the defect to thereby cause bending fracture, as described above. It is therefore recommended to control the rolling reduction in the above-mentioned temperature range to be relatively small to thereby suppress the degree of crushing.

Specifically, possible oxide inclusions present in a steel sheet having the specific chemical composition herein include single oxides of Al, Si, Mn, Ti, Mg, Ca, and rare-earth elements (REMs) and/or composite oxides of these elements. In consideration of the deformation temperatures of these oxide inclusions and the deformation capability of the base steel, it is important to control the crush and dispersion of these oxide inclusions by adequately controlling the rolling reduction in a temperature range from about 950° C. to room temperature. More specifically, it is important to control the crush and dispersion by optimizing the total rolling reduction of a rolling reduction at temperatures of about 950° C. or lower in hot rolling and a rolling reduction in cold rolling. More specifically, the total rolling reduction in the specific temperature range is preferably less than 97%, more preferably 96% or less, and furthermore preferably 95% or less in a steel sheet having a chemical composition specified in the present invention. The total rolling reduction is the total of a rolling reduction at temperatures of about 950° C. or lower in hot rolling and a rolling reduction in cold rolling. In contrast, if the total rolling reduction is excessively small, coarse inclusions may not be finely divided to thereby worsen the bending workability contrarily and may impede the manufacture of a thin steel sheet. For avoiding these, the total rolling reduction is preferably about 90% or more.

To reduce the total number of inclusion particles in the steel sheet, it is recommended to manufacture the steel by deoxidizing the material with aluminum to give a killed steel, primarily refining the killed steel in a converter or electric furnace, desulfurizing the refined steel in a ladle according to a ladle furnace (LF) process, and thereafter subjecting the same to vacuum degassing according typically to Ruhrstahl Heraeus (RH) process.

Conditions or procedures other than those mentioned above are not critical, and the steel sheet may be manufactured according to a common procedure by making an ingot in the above manner, subjecting the ingot to continuous casting to give a billet such as slab, heating the billet to a temperature of about 1100° C. to about 1250° C., and subsequently sequentially performing hot rolling, coiling, acid-pickling, and cold rolling. The hot rolling is preferably finished at a finish temperature of 950° C. or lower and equal to or higher than the $Ar_3$ point with a hot-rolling reduction of about 70% to about 95%. The cold rolling reduction herein is preferably from about 20% to about 70%.

Next, the prepared steel sheet is subjected to an annealing process. In the annealing process, tempering is preferably performed to give a martensite single-phase structure, in which the steel is held at a temperature typically of 800° C. to 1000° C. for 5 to 300 seconds, cooled from a temperature of from 600° C. to 1000° C. (quenching start temperature) to room temperature through quenching at a rate typically of 20° C. per second or more, the quenched steel is reheated to a temperature range of from 100° C. to 600° C., and held at the temperature range for 0 to 1200 seconds. The annealing process herein may be performed typically in a hot-dip galvanization line when a hot-dip galvanized steel sheet or hot-dip galvannealed steel sheet mentioned below is to be manufactured.

The present invention further includes, in addition to cold-rolled steel sheets, hot-dip galvanized steel sheets (GI steel sheets) prepared by subjecting the cold-rolled steel sheets to hot-dip galvanization; and hot-dip galvannealed steel sheets (GA steel sheets) prepared by subjecting the cold-rolled steel sheets to hot-dip galvanization and thereafter subjecting the galvanized steel sheets to an alloying treatment, respectively. This is because the suitably controlled number density of groups of inclusions in the cold-rolled steel sheets is not affected by the downstream plating treatment and alloying treatment and remains within the specific range specified in the present invention. These plating treatments improve the corrosion resistance of the steel sheets. The plating treatment and alloying treatment may be performed under conditions generally employed.

The high-strength cold-rolled steel sheets according to the present invention are usable for the manufacture of automotive strengthening parts including bumping parts such as bumpers, front and rear side members, and crush boxes; pillars such as center pillar reinforcing members; and body-constituting parts such as roof rail reinforcing members, side sills, floor members, and kick-up portions (or kick plates).

The present invention will be illustrated in further detail with reference to several working examples below. It should be noted, however, that these examples are never intended to limit the scope of the present invention; various alternations and modifications may be made without departing from the scope and spirit of the present invention and are all included within the technical scope of the present invention.

EXAMPLES

Material steels having chemical compositions given in Tables 1 and 2 (with the remainder including iron and inevitable impurities) were melted to give ingots. Specifically, the material steels were subjected to primary refining and then subjected to desulfurizing in a ladle. Where necessary, the steels after ladle refining were subjected to a vacuum degassing treatment according typically to the RH process. The steels were then subjected to continuous casting according to a common procedure to give slabs. The slabs were subjected sequentially to hot rolling, acid pickling according to a common procedure, and cold rolling and thereby yielded steel sheets (cold-rolled steel sheets) 1.6 mm thick. The hot rolling was performed under the conditions mentioned below. The total rolling reductions of the rolling reduction at temperatures of about 950° C. or lower in the hot rolling and the rolling reduction in the cold rolling are shown in Tables 3 to 5. Tables 3 to 5 indicate hot rolling reduction (%) at temperatures of 950° C. or lower and the cold rolling reduction (%), respectively, as references.

Hot Rolling Conditions

Heating temperature: 1250° C.

Finish temperature: 880° C.

Coiling temperature: 550° C.

Finish thickness: 2.0 to 5.4 mm

Next, the steel sheets were subjected to continuous annealing. In the continuous annealing, the steel sheets were held at annealing temperatures given in Tables 3 to 5 for 180 seconds, thereafter cooled to quenching start temperatures given in Tables 3 to 5 each at a cooling rate of 10° C. per second, quenched from the quenching start temperature to room temperature at a cooling rate of 20° C. per second or more, reheated to tempering temperatures given in Tables 3 to 5, and held at the tempering temperatures for 100 seconds to have a martensite single-phase structure. Next, specimens were prepared from the prepared steel sheets (steel hoops) and subjected to the observation of the structure and to the evaluations of characteristic properties mentioned below.

Measurement of Group of Inclusions

Each three specimens per one position were sampled from the steel hoops at positions of one-eighth, one-fourth, one-half, three-fourths, and seven-eighths the width in the width direction of the steel hoops. The sampling positions were arbitrary positions with respect to the rolling direction. The specimens each had a size of 30 mm square in a rolling plane. The specimens were ground in the rolling plane (normal direction (ND)) from the surface to 0.1 t (t: gauge) at intervals of 10 μm, the ground surfaces were visually observed under an optical microscope of 100 magnifications at every grinding (at every 10-μm grinding) to identify positions of inclusions. The number of specific groups of inclusions were counted, the counted number was converted to a number per the observed area and then converted to a number density per 100 $cm^2$ of the rolling plane. The determined number densities of specific groups of inclusions are shown in Tables 3 to 5. The specific groups of inclusions herein were the n-ary groups of inclusions in which the distance in the steel sheet rolling direction between outermost surfaces of two outermost particles of the n-ary group of inclusions was 100 μm or more.

Observation of Microstructure

Specimens 1.6 mm thick, 20 mm wide, and 20 mm long were cut from the steel hoops, cross sections of the specimens in parallel with the rolling direction were polished, subjected to LePera etching, and positions at a depth of one-fourth the thickness (t/4; wherein "t" is the gauge) were subjected to the measurements. Specifically, an observation area of about 80 μm long and 60 μm wide was observed under an optical microscope of 1000 magnifications. The types and area fractions (percent by area) of microstructures are shown in Tables 3 to 5. The measurements were performed in arbitrary five visual fields. In Tables 3 to 5, specimens indicated by "martensite" are specimens in which martensite structure occupies 100% of the structure.

Evaluation of Tensile Properties

The tensile strengths (TS) were measured in the following manner. Number 5 specimens for tensile tests prescribed in Japanese Industrial Standards (JIS) Z 2241 were sampled from the steel sheets so that a direction perpendicular to the steel sheet rolling direction was in parallel with the longitudinal direction of the specimens; and the tensile strengths of the specimens were measured in accordance with JIS Z 2241. The results are shown in Tables 3 to 5. In this experimental example, samples having tensile strengths of 880 MPa or more were evaluated as having high strength. For the sake of reference, the yield strengths (YS) and elongation (EL) of the steel sheets were measured, and the results are also shown in Tables 3 to 5.

Evaluation of Bending Workability: Measurement of Rate of Bending Fracture Caused by Specific Groups of Inclusions Folding bending was performed on 1000 specimens per sample under the following conditions. Regarding specimens undergone fracture, a cross section (thickness direction) of the fracture starting point was observed through scanning electron microscopy (SEM) and energy dispersive X-ray spectroscopy (EDX) to determine the presence or absence of any specific group of inclusions. It was found that all specific groups of inclusions acting as fracture starting points and causing fracture were present in a region ranging from the surface to a depth of 0.1 t.

The rate (°6) of bending fracture caused by specific groups of inclusions was determined according to following Expression (7). The results are shown in Tables 3 to 5.

$$\text{Rate (\%) of bending fracture} = 100 \times (\text{Number of specimens undergone bending fracture and containing at least one specific group of inclusions})/(\text{Total number of specimens, i.e., 1000}) \quad (7)$$

Conditions for Folding Bending

Process Machine: NC1-80(2)-B supplied by Aida Engineering, Ltd.

Process Speed: 40 strokes per minute

Clearance: gauge plus 0.1 mm

Die Punch Radius: critical bending radius (R/t) of the material plus 0.5/t wherein R represents the die radius (mm); and t represents the thickness (gauge) (mm) of the specimen Punch Angle: 90°

Specimen Size: t in thickness, 80 mm or more in width, and 30 mm in length, wherein the direction of L (longitudinal direction) was in parallel with the rolling direction of the steel hoop Bending Direction: The bending edge line was in parallel with the rolling direction of the specimen Test Number and Test Position: Each 200 specimens per one position were measured at positions of one-eighth, one-fourth, one-half, three-fourths, and seven-eighths the width in the width direction of the steel hoop, namely, a total of 1000 specimens were measured per one steel hoop, in which the positions were arbitrary positions with respect to the longitudinal direction of the steel hoop.

Determination of Critical Bending Radius

Bending was performed according to the following procedure at different bending radii of, for example, 2.0 mm, 1.5 mm, and 1.0 mm, and a minimum bending radius where no bending fracture occurred was defined as the critical bending radius.

Folding Bending

Measurement Positions and Tested Number: at one-fourth the width position, each two specimens per one bending radius The other conditions were the same as above.

Tables 1 to 5 demonstrate as follows. Sample Nos. 1, 3 to 5, 7 to 10, 12 to 14, 16, 17, 19, 20, 22 to 24, 26, 28, 29, 31, 33, 34, 36 to 38, 40, 42 to 46, 48 to 50, 52, 54, 55, and 57 to 61 each satisfied the conditions specified in the present invention, indicated small rates of bending fracture caused by specific groups of inclusions, and excelled in bending workability.

In contrast Sample Nos. 2, 6, 11, 15, 18, 21, 25, 27, 30, 32, 35, 39, 41, 47, 51, 53, and 56 had high number densities of groups of inclusions and were inferior in bending workability. This is probably because draft from about 950° C. to room temperature in the manufacturing process of these steel sheets was performed each at a rolling reduction out of the recommended range. More specifically, these steel sheets were manufactured at a total rolling reduction of a rolling reduction at temperatures of about 950 ° C. or lower in hot rolling and a rolling reduction in cold rolling of not less than 97%.

TABLE 1

| Steel | Chemical composition (percent by mass) | | | | | | | | | | | | | |
|---|---|---|---|---|---|---|---|---|---|---|---|---|---|---|
| type | C | Si | Mn | P | S | Al | N | Cr | B | Cu | Ni | Ti | Nb | V |
| A | 0.28 | 0.01 | 1.47 | 0.011 | 0.003 | 0.04 | 0.007 | 0.05 | 0.0007 | — | — | — | — | — |
| B | 0.17 | — | 1.49 | 0.018 | 0.002 | 0.07 | 0.006 | 1.00 | — | — | — | 0.15 | — | — |
| C | 0.20 | — | 1.48 | 0.004 | 0.001 | 0.04 | 0.006 | — | 0.0090 | — | — | — | — | 0.050 |
| D | 0.30 | 0.45 | 1.49 | 0.011 | 0.002 | 0.10 | 0.004 | — | — | — | — | — | — | — |

TABLE 1-continued

| Steel type | Chemical composition (percent by mass) C | Si | Mn | P | S | Al | N | Cr | B | Cu | Ni | Ti | Nb | V |
|---|---|---|---|---|---|---|---|---|---|---|---|---|---|---|
| E | 0.22 | 0.01 | 1.30 | 0.004 | 0.002 | 0.07 | 0.002 | 0.08 | 0.0016 | 0.10 | 0.11 | 0.05 | — | — |
| F | 0.21 | 0.01 | 1.00 | 0.004 | 0.002 | 0.07 | 0.003 | 0.08 | 0.0017 | 0.10 | 0.11 | 0.05 | 0.050 | — |
| G | 0.21 | 0.01 | 0.70 | 0.004 | 0.002 | 0.07 | 0.005 | 0.26 | 0.0017 | 0.10 | 0.11 | 0.03 | — | — |
| H | 0.24 | 0.01 | 1.00 | 0.004 | 0.002 | 0.07 | 0.004 | 0.08 | 0.0016 | 0.10 | 0.11 | 0.05 | — | — |
| I | 0.26 | 0.01 | 0.70 | 0.004 | 0.002 | 0.07 | 0.004 | 0.26 | 0.0017 | 0.10 | 0.11 | 0.03 | — | — |
| J | 0.23 | 0.01 | 1.00 | 0.004 | 0.002 | 0.07 | 0.004 | 0.08 | 0.0018 | 0.10 | 0.11 | 0.03 | — | — |
| K | 0.23 | 0.01 | 0.80 | 0.004 | 0.002 | 0.07 | 0.003 | 0.08 | 0.0017 | 0.10 | 0.11 | 0.03 | 0.030 | 0.030 |
| L | 0.25 | 0.01 | 0.80 | 0.004 | 0.002 | 0.07 | 0.002 | 0.08 | 0.0020 | 0.10 | 0.11 | 0.03 | — | 0.050 |
| M | 0.23 | 0.03 | 0.36 | 0.006 | 0.001 | 0.04 | 0.005 | 0.25 | 0.0019 | — | — | 0.03 | — | — |
| N | 0.24 | 0.20 | 1.27 | 0.012 | 0.003 | 0.04 | 0.004 | 0.23 | 0.0034 | 0.09 | — | 0.03 | — | — |
| O | 0.29 | 0.20 | 1.31 | 0.006 | 0.001 | 0.04 | 0.003 | 0.25 | 0.0037 | 0.10 | — | 0.03 | — | — |
| P | 0.29 | 0.26 | 1.31 | 0.006 | 0.001 | 0.04 | 0.005 | 0.25 | 0.0041 | 0.11 | — | 0.03 | — | 0.035 |
| Q | 0.30 | 0.01 | 0.30 | 0.004 | 0.002 | 0.02 | 0.007 | — | — | — | — | — | — | — |
| R | 0.29 | 0.01 | 1.00 | 0.010 | 0.003 | 0.03 | 0.008 | — | — | — | — | — | — | — |
| S | 0.20 | 0.04 | 0.20 | 0.004 | 0.003 | 0.10 | 0.002 | — | — | — | — | — | — | — |
| T | 0.19 | 0.01 | 1.49 | 0.006 | 0.002 | 0.03 | 0.003 | — | — | — | — | — | — | — |
| U | 0.12 | 0.01 | 0.30 | 0.015 | 0.002 | 0.07 | 0.004 | — | — | — | — | — | — | — |
| V | 0.12 | 0.01 | 1.48 | 0.004 | 0.002 | 0.05 | 0.004 | — | — | — | — | — | — | — |

TABLE 2

| Steel type | Chemical composition (percent by mass) C | Si | Mn | P | S | Al | N | Cr | B | Cu | Ni | Ti | Nb | V |
|---|---|---|---|---|---|---|---|---|---|---|---|---|---|---|
| W | 0.27 | 0.01 | 0.40 | 0.004 | 0.002 | 0.07 | 0.005 | 0.29 | 0.0018 | — | — | — | — | — |
| X | 0.28 | 0.02 | 0.20 | 0.005 | 0.002 | 0.07 | 0.004 | 0.22 | — | — | — | — | — | — |
| Y | 0.15 | 0.01 | 0.40 | 0.005 | 0.002 | 0.07 | 0.007 | — | — | 0.40 | — | — | — | — |
| Z | 0.12 | 0.04 | 1.40 | 0.013 | 0.003 | 0.08 | 0.008 | — | — | — | 0.40 | — | — | — |
| a | 0.30 | 0.01 | 0.30 | 0.004 | 0.002 | 0.08 | 0.006 | — | — | — | — | — | 0.030 | — |
| b | 0.13 | 0.10 | 1.00 | 0.009 | 0.002 | 0.07 | 0.004 | 0.08 | 0.0020 | 0.10 | 0.10 | 0.03 | 0.090 | 0.090 |
| c | 0.15 | 0.01 | 1.00 | 0.004 | 0.002 | 0.07 | 0.006 | — | — | 0.12 | 0.11 | — | — | 0.020 |
| d | 0.12 | 0.40 | 0.03 | 0.018 | 0.009 | 0.15 | 0.004 | 1.50 | 0.0005 | — | — | — | — | — |
| e | 0.20 | 0.50 | 0.01 | 0.003 | 0.003 | 0.05 | 0.003 | 2.00 | — | — | — | — | — | — |
| f | 0.23 | 0.03 | 0.80 | 0.009 | 0.008 | 0.14 | 0.006 | — | 0.0005 | — | — | — | 0.100 | — |
| g | 0.15 | 0.00 | 0.70 | 0.004 | 0.010 | 0.03 | 0.009 | — | — | 0.02 | 0.01 | — | — | — |
| h | 0.14 | 0.00 | 0.50 | 0.010 | 0.008 | 0.07 | 0.008 | — | 0.0001 | — | 0.01 | — | — | 0.100 |
| i | 0.18 | 0.08 | 1.00 | 0.017 | 0.002 | 0.08 | 0.010 | — | 0.0100 | — | — | 0.20 | — | 0.003 |
| j | 0.17 | 0.01 | 1.20 | 0.020 | 0.005 | 0.09 | 0.004 | — | — | 0.01 | 0.02 | — | 0.100 | — |
| k | 0.19 | 0.20 | 1.30 | 0.014 | 0.004 | 0.02 | 0.005 | — | 0.0050 | — | — | 0.01 | 0.010 | 0.500 |
| l | 0.29 | 0.30 | 0.03 | 0.004 | 0.003 | 0.03 | 0.003 | 0.04 | — | — | — | — | — | — |
| m | 0.17 | 0.01 | 1.40 | 0.004 | 0.005 | 0.07 | 0.005 | 0.08 | 0.0017 | 0.10 | 0.10 | 0.05 | — | — |
| n | 0.19 | 0.02 | 1.40 | 0.003 | 0.006 | 0.07 | 0.004 | 0.08 | 0.0018 | 0.10 | 0.10 | 0.05 | — | — |
| o | 0.15 | 0.02 | 1.40 | 0.004 | 0.004 | 0.07 | 0.005 | 0.08 | 0.0018 | 0.10 | 0.10 | 0.05 | — | — |
| p | 0.17 | 0.01 | 1.20 | 0.002 | 0.005 | 0.07 | 0.006 | 0.08 | 0.0018 | 0.10 | 0.10 | 0.05 | — | — |

TABLE 3

| No. | Steel type | Hot rolling reduction at 950° C. or lower (%) | Cold rolling reduction (%) | Total rolling reduction (%) | Annealing temperature (° C.) | Quenching start temperature (° C.) | Tempering temperature (° C.) |
|---|---|---|---|---|---|---|---|
| 1 | A | 90 | 33 | 93 | 900 | 890 | 180 |
| 2 | A | 94 | 67 | 98 | 930 | 900 | 200 |
| 3 | B | 90 | 40 | 94 | 920 | 650 | 500 |
| 4 | C | 91 | 48 | 95 | 890 | 700 | 200 |
| 5 | D | 92 | 48 | 96 | 900 | 700 | 300 |
| 6 | D | 94 | 48 | 97 | 850 | 650 | 200 |
| 7 | E | 89 | 57 | 95 | 900 | 725 | 200 |
| 8 | F | 89 | 57 | 95 | 900 | 725 | 200 |
| 9 | G | 90 | 60 | 96 | 900 | 700 | 200 |
| 10 | H | 75 | 60 | 90 | 900 | 725 | 200 |
| 11 | H | 93 | 60 | 97 | 920 | 700 | 200 |
| 12 | I | 91 | 48 | 95 | 900 | 725 | 200 |
| 13 | J | 90 | 67 | 94 | 900 | 725 | 200 |
| 14 | K | 91 | 48 | 95 | 900 | 725 | 200 |
| 15 | K | 95 | 57 | 98 | 900 | 880 | 200 |

TABLE 3-continued

| | | | | | | | |
|---|---|---|---|---|---|---|---|
| 16 | L | 91 | 48 | 95 | 900 | 725 | 200 |
| 17 | M | 90 | 60 | 96 | 900 | 870 | 100 |
| 18 | M | 95 | 70 | 99 | 920 | 900 | 200 |
| 19 | N | 91 | 48 | 95 | 890 | 870 | 200 |
| 20 | O | 80 | 67 | 93 | 890 | 870 | 250 |
| 21 | O | 93 | 60 | 97 | 890 | 650 | 200 |

| No. | YP (MPa) | TS (MPa) | EL (%) | Microstructure (percent by area) | Number density of specific groups of inclusions (number/100 $cm^2$) | Rate of bending fracture caused by specific groups of inclusions (%) |
|---|---|---|---|---|---|---|
| 1 | 1120 | 1320 | 6.7 | martensite | 54 | 0.9 |
| 2 | 1100 | 1310 | 6.4 | martensite | 150 | 4.0 |
| 3 | 1100 | 1180 | 6.7 | martensite 95% + ferrite 5% | 22 | 0.8 |
| 4 | 1280 | 1470 | 5.8 | martensite | 40 | 0.5 |
| 5 | 1370 | 1580 | 7.0 | martensite | 88 | 1.0 |
| 6 | 1320 | 1510 | 6.8 | martensite | 127 | 3.0 |
| 7 | 1358 | 1587 | 6.1 | martensite | 56 | 0.3 |
| 8 | 1232 | 1441 | 5.4 | martensite | 54 | 0.2 |
| 9 | 1111 | 1402 | 5.5 | martensite 97% + ferrite 3% | 76 | 0.6 |
| 10 | 1325 | 1559 | 5.2 | martensite | 59 | 0.6 |
| 11 | 1330 | 1560 | 5.1 | martensite | 132 | 2.5 |
| 12 | 1346 | 1650 | 5.5 | martensite | 98 | 0.8 |
| 13 | 1289 | 1568 | 5.4 | martensite | 104 | 1.0 |
| 14 | 1340 | 1591 | 5.8 | martensite | 108 | 1.1 |
| 15 | 1350 | 1601 | 5.5 | martensite | 125 | 2.4 |
| 16 | 1414 | 1674 | 5.3 | martensite | 75 | 0.6 |
| 17 | 1216 | 1594 | 5.9 | martensite | 115 | 1.8 |
| 18 | 1170 | 1530 | 6.2 | martensite | 143 | 4.3 |
| 19 | 1364 | 1640 | 5.7 | martensite | 99 | 0.8 |
| 20 | 1460 | 1683 | 5.2 | martensite | 80 | 0.5 |
| 21 | 1530 | 1720 | 4.7 | martensite | 153 | 4.7 |

TABLE 4

| No. | Steel type | Hot rolling reduction at 950° C. or lower (%) | Cold rolling reduction (%) | Total rolling reduction (%) | Annealing temperature (° C.) | Quenching start temperature (° C.) | Tempering temperature (° C.) |
|---|---|---|---|---|---|---|---|
| 22 | P | 91 | 48 | 95 | 890 | 870 | 250 |
| 23 | Q | 85 | 63 | 94 | 900 | 880 | 200 |
| 24 | R | 80 | 67 | 93 | 900 | 880 | 200 |
| 25 | R | 95 | 57 | 98 | 900 | 880 | 200 |
| 26 | S | 91 | 33 | 94 | 900 | 880 | 200 |
| 27 | S | 94 | 48 | 97 | 900 | 870 | 200 |
| 28 | T | 78 | 68 | 92 | 900 | 880 | 200 |
| 29 | U | 88 | 36 | 92 | 900 | 880 | 200 |
| 30 | U | 94 | 67 | 98 | 920 | 900 | 200 |
| 31 | V | 94 | 21 | 95 | 900 | 880 | 200 |
| 32 | V | 94 | 48 | 97 | 900 | 900 | 200 |
| 33 | W | 90 | 40 | 94 | 900 | 880 | 200 |
| 34 | X | 91 | 48 | 95 | 900 | 880 | 200 |
| 35 | X | 94 | 67 | 98 | 920 | 890 | 200 |
| 36 | Y | 90 | 67 | 94 | 900 | 880 | 200 |
| 37 | Z | 91 | 48 | 95 | 900 | 880 | 200 |
| 38 | a | 90 | 60 | 96 | 900 | 880 | 200 |
| 39 | a | 94 | 48 | 97 | 920 | 900 | 400 |
| 40 | b | 91 | 48 | 95 | 900 | 880 | 200 |
| 41 | b | 94 | 65 | 98 | 900 | 900 | 200 |

| No. | YP (MPa) | TS (MPa) | EL (%) | Microstructure (percent by area) | Number density of specific groups of inclusions (number/100 $cm^2$) | Rate of bending fracture caused by specific groups of inclusions (%) |
|---|---|---|---|---|---|---|
| 22 | 1581 | 1764 | 5.3 | martensite | 94 | 0.8 |
| 23 | 1350 | 1683 | 5.3 | martensite | 43 | 0.2 |
| 24 | 1424 | 1760 | 5.4 | martensite | 88 | 1.0 |
| 25 | 1450 | 1780 | 5.2 | martensite | 133 | 3.7 |

TABLE 4-continued

| | | | | | | |
|---|---|---|---|---|---|---|
| 26 | 1111 | 1348 | 6.1 | martensite | 100 | 1.5 |
| 27 | 1100 | 1350 | 6.0 | martensite | 139 | 4.2 |
| 28 | 1268 | 1518 | 6.4 | martensite | 30 | 0.4 |
| 29 | 944 | 1108 | 6.7 | martensite | 75 | 0.8 |
| 30 | 940 | 1100 | 6.8 | martensite | 125 | 2.2 |
| 31 | 1110 | 1295 | 6.3 | martensite | 69 | 0.9 |
| 32 | 1100 | 1280 | 6.7 | martensite | 154 | 4.5 |
| 33 | 1296 | 1602 | 5.4 | martensite | 47 | 0.4 |
| 34 | 1291 | 1603 | 5.3 | martensite | 59 | 0.8 |
| 35 | 1320 | 1610 | 5.2 | martensite | 134 | 3.8 |
| 36 | 1022 | 1202 | 6.7 | martensite | 39 | 0.3 |
| 37 | 1026 | 1219 | 6.6 | martensite | 65 | 0.6 |
| 38 | 1097 | 1279 | 6.2 | martensite | 116 | 1.8 |
| 39 | 1120 | 1356 | 7.2 | martensite | 123 | 2.3 |
| 40 | 1122 | 1323 | 6.5 | martensite | 108 | 1.8 |
| 41 | 1090 | 1315 | 6.4 | martensite | 154 | 4.8 |

TABLE 5

| No. | Steel type | Hot rolling reduction at 950° C. or lower (%) | Cold rolling reduction (%) | Total rolling reduction (%) | Annealing temperature (° C.) | Quenching start temperature (° C.) | tempering temperature (° C.) |
|---|---|---|---|---|---|---|---|
| 42 | c | 85 | 33 | 90 | 900 | 880 | 200 |
| 43 | c | 71 | 65 | 90 | 900 | 880 | 400 |
| 44 | d | 88 | 36 | 92 | 900 | 880 | 200 |
| 45 | d | 88 | 36 | 92 | 900 | 880 | 500 |
| 46 | e | 82 | 50 | 91 | 900 | 900 | 200 |
| 47 | e | 94 | 67 | 98 | 900 | 700 | 200 |
| 48 | f | 90 | 40 | 94 | 900 | 870 | 200 |
| 49 | g | 80 | 67 | 93 | 900 | 880 | 200 |
| 50 | h | 91 | 48 | 95 | 900 | 880 | 200 |
| 51 | h | 93 | 60 | 97 | 900 | 820 | 200 |
| 52 | i | 92 | 48 | 96 | 900 | 820 | 200 |
| 53 | i | 93 | 60 | 97 | 900 | 880 | 200 |
| 54 | j | 82 | 50 | 91 | 900 | 880 | 200 |
| 55 | k | 90 | 33 | 93 | 900 | 870 | 200 |
| 56 | k | 94 | 67 | 98 | 900 | 870 | 200 |
| 57 | l | 88 | 36 | 92 | 900 | 880 | 200 |
| 58 | m | 89 | 57 | 95 | 900 | 820 | 200 |
| 59 | n | 89 | 57 | 95 | 900 | 820 | 200 |
| 60 | o | 89 | 57 | 95 | 900 | 820 | 200 |
| 61 | p | 89 | 57 | 95 | 900 | 820 | 200 |

| No. | YP (MPa) | TS (MPa) | EL (%) | Microstructure (percent by area) | Number density of specific groups of inclusions (number/100 $cm^2$) | Rate of bending fracture caused by specific groups of inclusions (%) |
|---|---|---|---|---|---|---|
| 42 | 1064 | 1249 | 6.4 | martensite | 21 | 0.2 |
| 43 | 901 | 1033 | 7.1 | martensite | 45 | 0.5 |
| 44 | 1009 | 1213 | 6.1 | martensite | 42 | 0.4 |
| 45 | 803 | 912 | 7.1 | martensite | 37 | 0.3 |
| 46 | 980 | 1221 | 7.3 | martensite | 39 | 0.3 |
| 47 | 1020 | 1270 | 7.1 | martensite | 142 | 3.8 |
| 48 | 1340 | 1574 | 5.8 | martensite | 54 | 0.6 |
| 49 | 1132 | 1350 | 6.2 | martensite | 63 | 0.4 |
| 50 | 1140 | 1370 | 5.4 | martensite | 53 | 0.5 |
| 51 | 1123 | 1328 | 5.3 | martensite | 136 | 3.4 |
| 52 | 1240 | 1475 | 6.3 | martensite | 117 | 1.8 |
| 53 | 1233 | 1420 | 6.2 | martensite | 128 | 2.1 |
| 54 | 1378 | 1520 | 5.2 | martensite | 28 | 0.2 |
| 55 | 1420 | 1590 | 4.8 | martensite | 69 | 0.6 |
| 56 | 1430 | 1595 | 4.7 | martensite | 137 | 4.5 |
| 57 | 1490 | 1650 | 4.5 | martensite | 43 | 0.5 |
| 58 | 1209 | 1439 | 5.5 | martensite | 40 | 0.4 |
| 59 | 1254 | 1503 | 52.0 | martensite | 66 | 0.7 |
| 60 | 1164 | 1375 | 5.7 | martensite | 73 | 0.7 |
| 61 | 1181 | 1408 | 5.5 | martensite | 84 | 0.9 |

What is claimed is:

1. A cold-rolled steel sheet comprising a steel sheet having a composition of:

a carbon (C) content of 0.12 to 0.3 percent by mass (hereinafter "%" means % by mass), a silicon (Si) content of 0.5% or less, a manganese (Mn) content of less than 1.5%, an aluminum (Al) content of 0.15% or less, a nitrogen (N) content of 0.01% or less, a phosphorus (P) content of 0.02% or less, and a sulfur (S) content of 0.01% or less, with the remainder including iron and inevitable impurities, wherein the steel sheet has a martensite single-phase structure as steel microstructure, and wherein, in a surface region from a surface to a depth one-tenth the gauge of the steel sheet, the number density of n-ary groups of inclusions is 120 or less per 100 $cm^2$ of a rolling plane, in which each of the n-ary groups of inclusions is determined by an n-th Determination mentioned below, and, in each of the n-ary groups of inclusions, the distance in a steel sheet rolling direction between outermost surfaces of two outermost particles of the n-ary group of inclusions is 100 μm or more:

n-th Determination the "n-ary group of inclusions" refers to a group of inclusions which includes (1) an inclusion selected from an (n−1)-ary group of inclusions where "n" is an integer of 2 or more and inclusion particles where "n" is 1; and (2) at least one inclusion selected from a neighboring x-ary group of inclusions and inclusion particles where "x" is an integer from 0 to n−1, in which the minimum intersurface distance (λ) of nearest neighbor particles between the (n−1)-ary group of inclusions and the x-ary group of inclusions satisfies a condition represented by following Expression (1) and is 60 μm or less:

$$\lambda \leq 4.0 \times 10^5 \left(\frac{1}{\sigma_y}\right)^2 (d_1 + d_2) \quad (1)$$

wherein:

λ represents the minimum intersurface distance (μm) of nearest neighbor particles between the (n−1)-ary group of inclusions and the x-ary group of inclusions;

$\sigma_y$ represents the yield strength (MPa) of the steel sheet;

$d_1$ represents the particle size (μm), in a steel sheet rolling direction, of the (n−1)-ary group of inclusions when "n" is 1, or represents the distance (μm), in the steel sheet rolling direction, between outermost surfaces of two outermost particles of the (n−1)-ary group of inclusions when "n" is 2 or more; and $d_2$ represents the particle size (μm), in a steel sheet rolling direction, of the x-ary group of inclusions when "x" is 0, or represents the distance (μm), in the steel sheet rolling direction, between outermost surfaces of two outermost particles of the x-ary group of inclusions when "x" is 1 or more.

2. The cold-rolled steel sheet according to claim 1, wherein the steel sheet further comprises, as additional element(s), at least one element selected from the group consisting of:

chromium (Cr) in a content of 2% by mass or less and boron (B) in a content of 0.01% by mass or less.

3. The cold-rolled steel sheet according to claim 1, wherein the steel sheet further comprises, as additional element(s), at least one element selected from the group consisting of:

copper (Cu) in a content of 0.5% by mass or less, nickel (Ni) in a content of 0.5% by mass or less, and titanium (Ti) in a content of 0.2% by mass or less.

4. The cold-rolled steel sheet according to claim 1, wherein the steel sheet further comprises, as additional element(s), at least one element selected from the group consisting of:

vanadium (V) in a content of 0.1% by mass or less and niobium (Nb) in a content of 0.1% by mass or less.

5. A hot-dip galvanized steel sheet comprising the cold-rolled steel sheet according to claim 1; and a hot-dip galvanized coating formed on the cold-rolled steel sheet through hot-dip galvanization.

6. A hot-dip galvannealed steel sheet comprising the cold-rolled steel sheet according to claim 1; and a hot-dip galvannealed coating formed on the cold-rolled steel sheet through hot-dip galvanization and subsequent alloying.

7. A cold-rolled steel sheet comprising a steel sheet having tensile strength of 880 MPa or more and a composition of:

a carbon (C) content of 0.12 to 0.3 percent by mass (hereinafter "%" means % by mass), a silicon (Si) content of 0.02 to 0.5%, a manganese (Mn) content of 0.1 to less than 1.5%, an aluminum (Al) content of 0.05 to 0.15%, a nitrogen (N) content of 0.001 to 0.01%, a phosphorus (P) content of 0.02% or less, and a sulfur (S) content of 0.01% or less, with the remainder including iron and inevitable impurities, wherein the steel sheet has a martensite single-phase structure as steel microstructure, and wherein, in a surface region from a surface to a depth one-tenth the gauge of the steel sheet, the number density of n-ary groups of inclusions is 120 or less per 100 $cm^2$ of a rolling plane, in which each of the n-ary groups of inclusions is determined by an n-th Determination mentioned below, and, in each of the n-ary groups of inclusions, the distance in a steel sheet rolling direction between outermost surfaces of two outermost particles of the n-ary group of inclusions is 100 μm or more:

n-th Determination the "n-ary group of inclusions" refers to a group of inclusions which includes (1) an inclusion selected from an (n−1)-ary group of inclusions where "n" is an integer of 2 or more and inclusion particles where "n" is 1; and (2) at least one inclusion selected from a neighboring x-ary group of inclusions and inclusion particles where "x" is an integer from 0 to n−1, in which the minimum intersurface distance (λ) of nearest neighbor particles between the (n−1)-ary group of inclusions and the x-ary group of inclusions satisfies a condition represented by following Expression (1) and is 60 μm or less:

$$\lambda \leq 4.0 \times 10^5 \left(\frac{1}{\sigma_y}\right)^2 (d_1 + d_2) \quad (1)$$

wherein:

λ represents the minimum intersurface distance (μm) of nearest neighbor particles between the (n−1)-ary group of inclusions and the x-ary group of inclusions;

$\sigma_y$ represents the yield strength (MPa) of the steel sheet;

$d_1$ represents the particle size (μm), in a steel sheet rolling direction, of the (n−1)-ary group of inclusions when "n" is 1, or represents the distance (μm), in the steel sheet rolling direction, between outermost surfaces of two outermost particles of the (n−1)-ary group of inclusions when "n" is 2 or more; and $d_2$ represents the particle size (μm), in a steel sheet rolling direction, of the x-ary group of inclusions when "x" is 0, or represents the distance (μm), in the steel sheet rolling direction, between outermost surfaces of two outermost particles of the x-ary group of inclusions when "x" is 1 or more.

8. A cold-rolled steel sheet according to claim 7, wherein the steel sheet has a tensile strength of 980 MPa or more.

9. A cold-rolled steel sheet according to claim 7, wherein the steel sheet has a tensile strength of 980 MPa or more and a composition of:

a carbon (C) content of 0.15 to 0.26 percent by mass (hereinafter "%" means % by mass), a silicon (Si) content of 0.02 to 0.4%, a manganese (Mn) content of 0.1 to 1.4%, an aluminum (Al) content of 0.05 to 0.10%, a nitrogen (N) content of 0.001 to 0.008%, a phosphorus (P) content of 0.01% or less, and a sulfur (S) content of 0.005% or less, with the remainder including iron and inevitable impurities.

* * * * *